US006464544B1

(12) United States Patent
Yamamoto et al.

(10) Patent No.: US 6,464,544 B1
(45) Date of Patent: Oct. 15, 2002

(54) CONNECTOR

(75) Inventors: Masaya Yamamoto, Shizuoka (JP); Kimihiro Abe, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 12 days.

(21) Appl. No.: 09/717,022

(22) Filed: Nov. 22, 2000

(30) Foreign Application Priority Data

Nov. 25, 1999 (JP) ..... 11-333890

(51) Int. Cl.[7] ..... H01R 13/514
(52) U.S. Cl. ..... 439/752; 439/595
(58) Field of Search ..... 439/752, 751, 439/595, 596, 483

(56) References Cited

U.S. PATENT DOCUMENTS 5,066,252 A * 11/1991 Kato et al. ..... 439/752
5,252,096 A * 10/1993 Okada ..... 439/752
5,618,207 A * 4/1997 Maejima ..... 439/595

FOREIGN PATENT DOCUMENTS

JP 3-29276 2/1991 ..... H01R/13/42

* cited by examiner

*Primary Examiner*—Gary F. Paumen
*Assistant Examiner*—James R. Harvey
(74) *Attorney, Agent, or Firm*—Sughrue Mion, PLLC

(57) ABSTRACT

A housing body is provided with a pair of first retainers and a plurality of terminal chambers for accommodating a plurality of connection terminals. A spacer is attached to the housing body for doubly retaining the connection terminals in the housing body. The spacer is provided with a pair of second retainers which is to be engaged with the first retainers when the spacer is attached to the housing body. A pair of finger pads are respectively protruded from outer faces of both side walls of the housing body, on which an user's fingers are abutted to perform connection with respect to a mating connector. The spacer is attached into a mounting hole formed in either a top face or a bottom face of the housing body so as to communicate with the respective terminal chambers and to include inner faces of the both side walls of the housing body. The width of the mounting hole is widened outwardly at portions opposing to the respective finger pads. At least a part of the first retainers are provided in the widened portion of the mounting hole.

5 Claims, 12 Drawing Sheets

CONNECTOR

BACKGROUND OF THE INVENTION

This invention relates to a connector provided with a spacer for doubly retaining a plurality of connection terminals, received in a housing body.

A related connector comprises a connector housing, having terminal receiving chambers, and connection terminals received respectively in these terminal receiving chambers. A lance is formed integrally within each of the terminal receiving chambers, and the inserted connection terminal is engaged with this lance, and is prevented from withdrawal.

However, a sufficient retaining force for the connection terminal can not be provided only by the lance, and therefore in recent years, there have been used a construction in which a spacer, separate from a connector housing, is attached to the connector housing so as to doubly retain the connection terminals.

FIG. 19 shows a connector disclosed in Japanese Patent Publication No. 3-29276A.

The connector 1 shown in FIG. 19 comprises a housing body 2 for receiving a plurality of connection terminals (not shown), and a spacer 3 for being attached to the housing body 2.

A plurality of terminal receiving chambers 4 are formed through the housing body 2 in a forward-rearward direction, and are arranged in two (upper and lower) rows. A spacer mounting hole 6 is formed in an upper wall 5 of the housing body 2, and extends downwardly therefrom, the spacer mounting hole 6 being disposed perpendicularly to the plurality of terminal receiving chambers 4. A lance (not shown) is formed integrally within each of the plurality of terminal receiving chambers 4.

The spacer mounting hole 6 is a rectangular hole communicating with the plurality of terminal receiving chambers 4, and grooves 8 are formed in a rear edge portion of the spacer mounting hole 6 intermediate opposite sides thereof, and are spaced a suitable distance from each other, the grooves 8 being continuous with a partition wall 7 separating the upper and lower rows of terminal receiving chambers 4 from each other. Lock arms 9 for the spacer 3 are formed integrally in the groove portions 8, respectively.

The spacer 3 of a frame-like configuration includes a pair of upper and lower lid members 10 and 11 interconnected by a plurality of partition plates 12. The spacer 3 has ribs 13 for being engaged respectively with the lock arms 9. The ribs 13 are disposed at a level slightly lower than the upper lid member 10. Each of these ribs has a sufficient thickness substantially equal to the thickness of the lock arm 9, and can be received in the groove 8.

When the spacer 3 is pushed into the spacer mounting hole 6, so that the lock arms 9 are elastically deformed to be engaged respectively with the ribs 13, retaining walls 14 of the spacer 3 engage the connection terminals (not shown). The connection terminals are doubly retained by the housing body 2 and the spacer 3, and therefore are prevented from withdrawal.

Incidentally, in recent years, it has been desired to achieve a compact design of parts such as a connector.

In the above related technique, however, the lock arms 9 are formed at the rear edge portion of the spacer mounting hole 6 intermediate the opposite sides thereof, and are spaced a suitable distance from each other, and therefore the outer size of the housing body 2 has been increased by an amount corresponding to a space for retaining the spacer 3, that is, the space for the grooves 8.

The above retaining space is indispensable to the connector 1 provided with the spacer 3, and therefore it has been difficult to meet the requirement of the compact design.

If the above retaining space is reduced so as to form the housing body 2 into a compact design, the retaining force for retaining the spacer 3 is reduced, which has led to possibilities that the spacer 3 is displaced upwardly relative to the upper wall 5 and that the spacer 3 is disengaged from the housing body during transport.

Usually, that portion of the housing body 2, in which the spacer 3 is mounted, is disposed at that portion of this housing body on which a mating connector is fitted, and therefore when the outer size of the housing body 2 increases, the outer size of the mating connector naturally increases.

Therefore, in view of the foregoing, it is necessary to make improvements so as to achieve the compact design of the connector.

SUMMARY OF THE INVENTION

This invention has been made under the above circumstances, and an object of the invention is to provide a connector which is formed into a compact design while maintaining a sufficient retaining force for a spacer.

In order to achieve the above object, according to the present invention, there is provided a connector comprising:

- a housing body provided with a pair of first retainers and a plurality of terminal chambers for accommodating a plurality of connection terminals;
- a spacer attached to the housing body for doubly retaining the connection terminals in the housing body, provided with a pair of second retainers which is to be engaged with the first retainers when the spacer is attached to the housing body; and
- a pair of finger pads respectively protruded from outer faces of both side walls of the housing body, on which an user's fingers are abutted to perform connection with respect to a mating connector,
- wherein the spacer is attached into a mounting hole formed in either a top face or a bottom face of the housing body so as to communicate with the respective terminal chambers and to include inner faces of the both side walls of the housing body;
- wherein the width of the mounting hole is widened outwardly at portions opposing to the respective finger pads; and
- wherein at least a part of the first retainers are provided in the widened portion of the mounting hole.

According to the above configuration, the finger pads are formed by reducing the width of the housing body, and the portion for receiving the retainer of the spacer having a sufficient thickness to keep a sufficient retaining ability is formed inside of the finger pads. Therefore, there is achieved an advantageous effect that there can be provided the connector which is formed into a compact design while maintaining the sufficient retaining force for the spacer.

Preferably, each of the second retainers includes a provisional retainer for provisionally engaging the spacer with the housing body, and a complete retainer for completely engaging the spacer with the housing body.

According to the above configuration, the connection terminals can be received in the housing body, with the spacer held in a provisionally-retained condition. Therefore, workability can be improved.

Preferably, the provisional retainers and the complete retainers are provided as projections. Here, either a slit or a through hole is formed in the vicinity of the respective provisional retainers and the complete retainers.

According to the above configuration, when provisionally or completely retaining the spacer, the provisional retainer or the complete retainer is elastically deformed because of the provision of the through hole or the slit, and therefore the attachment of the spacer can be easily effected.

Preferably, the spacer includes a front holder connected via a hinge, and the front holder is engaged with a front portion of the housing body to regulate positions of the connection terminals accommodated in the housing body.

According to the above configuration, even when the spacer has the added function (position regulating of the connection terminals), the compact design can be achieved.

Preferably, a widthwise dimension of the connector including the finger pads is so determined as to be smaller than a widthwise dimension of the mating connector.

According to the above configuration, when the connector is connected to the mating connector, the size of the two connectors will not be increased by providing the pair of finger pads.

DETAILED DESCRIPTION OF THE PREFERRED EMBODIMENTS

One preferred embodiment of the present invention will now be described with reference to the drawings.

Figure 1:
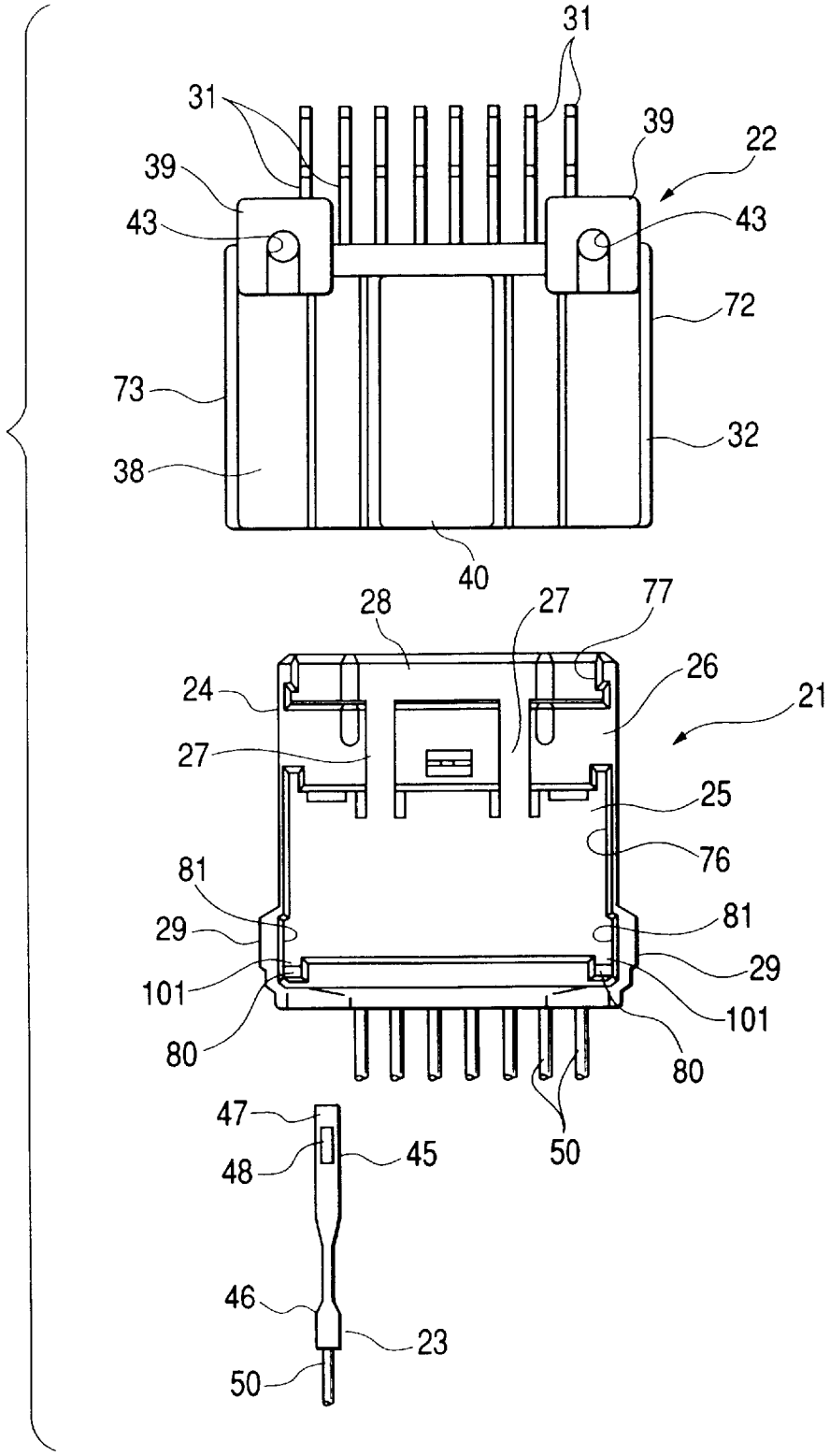
FIG. 1 is a bottom view showing a connector according to one preferred embodiment of the invention.
Figure 2:
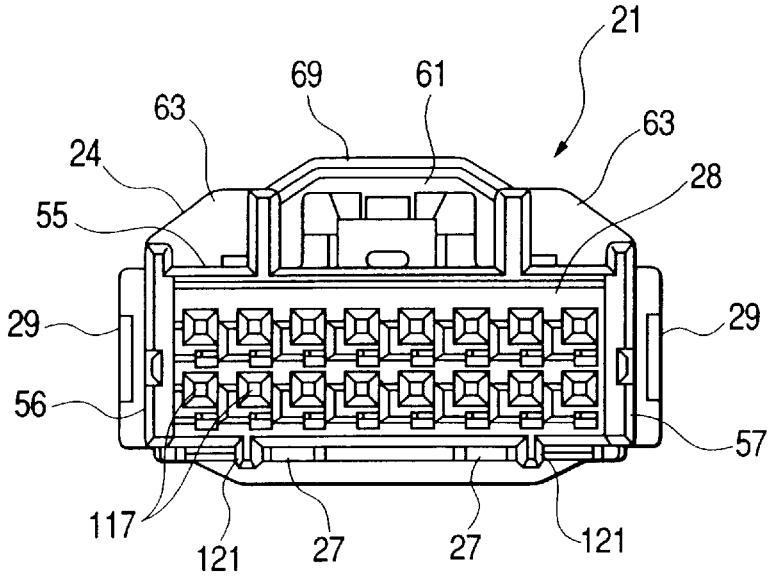
FIG. 2 is a front view of the connector of FIG. 1.
Figure 3:
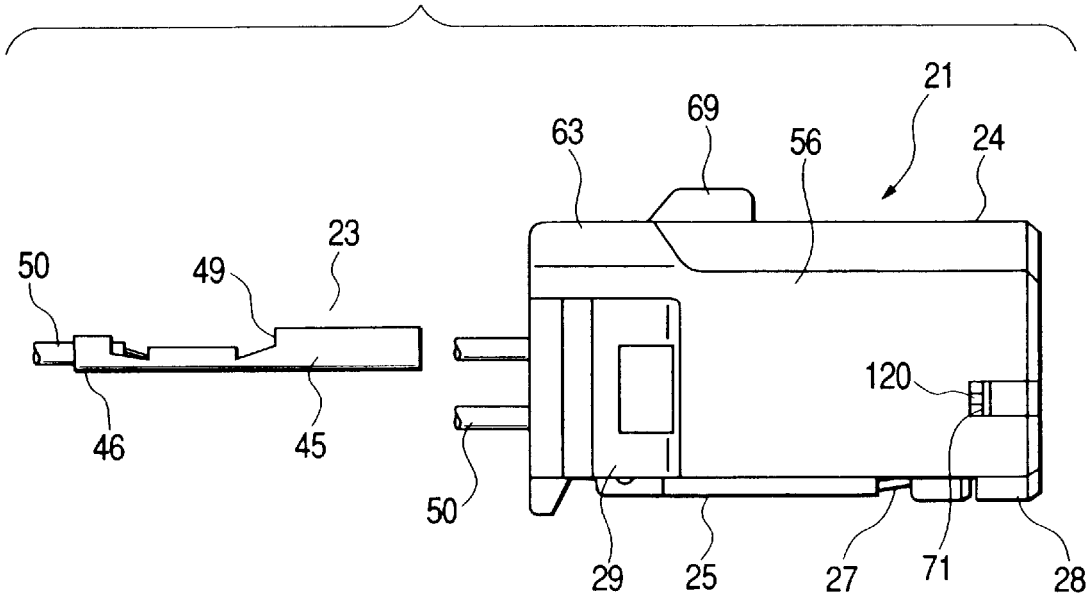
FIG. 3 is a side view of the connector of FIG. 1.
Figure 4:
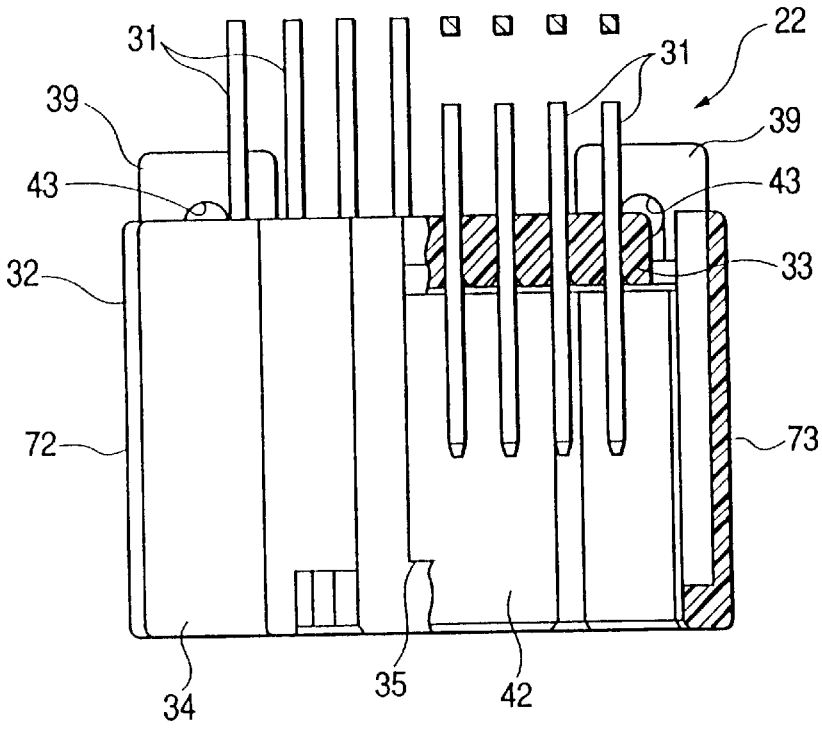
FIG. 4 is a partly cross-sectional, plan view of a mating connector of FIG. 1.
Figure 5:
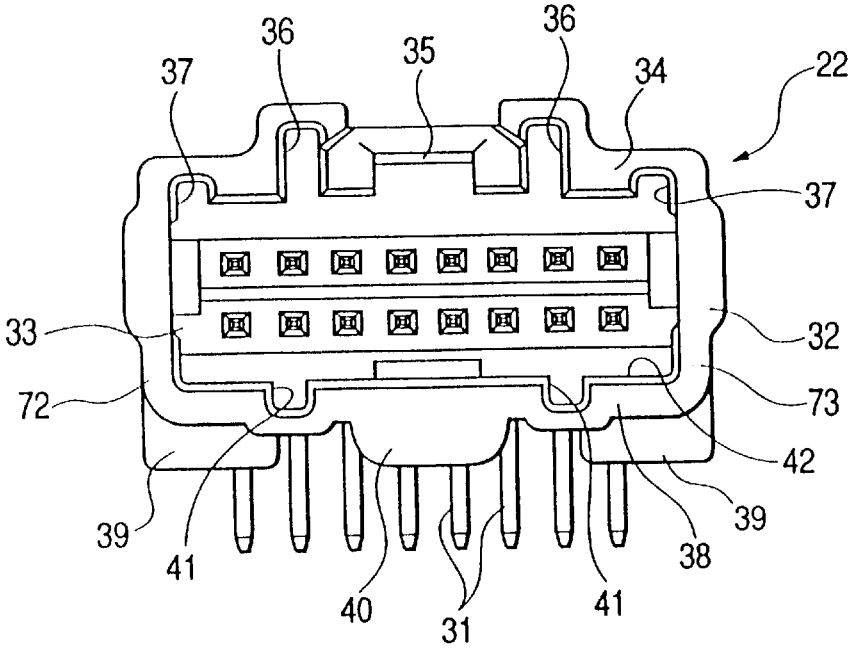
FIG. 5 is a front view of the mating connector of FIG. 1.

FIG. 1 is a bottom view showing one preferred embodiment of a connector of the invention. FIG. 2 is a front view of the connector of FIG. 1, FIG. 3 is a side view of the connector of FIG. 1, FIG. 4 is a partly cross-sectional, plan view of a mating connector of FIG. 1, and FIG. 5 is a front view of the mating connector of FIG. 1.

In FIG. 1, reference numeral 21 denotes the connector of the present invention.

The connector 21 can be electrically connected to the mating connector 22 adapted to be fixedly mounted on a wiring board (not shown). The connector 21 comprises a plurality of female connection terminals 23, a housing body 24 for receiving these connection terminals 23, and a spacer 25 attached to the housing body 24 so as to doubly retain the connection terminals 23. The spacer 25 can be attached to the housing body 24 of the connector 21 from the lower side thereof at which a lower wall 26 is provided.

The spacer 25 has a front holder 28 integrally connected thereto through hinges 27 (see FIG. 2 also), and this front holder 28 can be fitted on a front portion of the housing body 24. The front holder 28 serves as a stopper for the connection terminals 23 mounted in the housing body 24.

The connector 21 has a pair of finger pads 29 (see also FIGS. 2 and 3) formed on the housing body 24, and the connector 1 can be pushed into the mating connector, with the fingers held respectively on the finger pads 29, so as to be connected to the mating connector 22.

When the connector 21 is connected to the mating connector 22, connection terminals 31 (described later) in the mating connector 22 are inserted into the housing body 24 through the front holder 28, and are electrically connected to the connection terminals 23, respectively.

The mating connector 22 comprises the plurality of male connection terminals 31, soldered at their one ends to the wiring board (not shown), and a box-shaped connector housing 32 receiving the other end portions of the connection terminals 31, that side of the connector housing 32 to be opposed to the connector 21 being open.

As shown in FIG. 4, the plurality of connection terminals 31 are fixed to a rear end wall 33 of the connector housing 32, and project from this end wall 33 toward the open end of the connector housing 32. These connection terminals are arranged in two (upper and lower) rows (see FIG. 5). Each of the connection terminals 31 is bent into an L-shape.

As shown in FIGS. 4 and 5, the connector housing 32 is molded of a synthetic resin, and a lock portion 35 is formed on an upper wall 34 of this connector housing. Deep-groove guides 36, as well as shallow-groove guides 37, are formed in the upper wall 34, and are disposed on opposite sides of the lock portion 35, respectively.

Fixing portions 39 (see FIG. 1 also) for the wiring board (not shown), as well as a support portion 40 (see FIG. 1 also), are formed integrally on a lower wall 38 opposed to the upper wall 34. Shallow-groove guides 41 and 41 are formed in the lower wall 38, and are disposed on opposite sides of the support portion 40, respectively.

The guides 37, 38 and 41 communicate with a fitting portion 42 for receiving the connector 21 (see FIG. 1). A screw hole 43 (see FIG. 1) is formed in each of the fixing portions 39. The support portion 40 is adapted to be held in contact with the wiring board (not shown) so as to prevent the shaking of the mating connector 22.

Referring back to FIG. 1, the connector 21 is designed such that the widthwise dimension (right-left direction) is reduced, while maintaining a sufficient retaining force for retaining the spacer 25. To achieve this, the pair of finger pads 29 are utilized. Since the connector 21 is formed into a compact design, the mating connector 22 for fitting on the connector 21 is also formed into a compact design.

In the present specification, the terms "upper, lower, right, left, front and rear" are defined as follows. The housing body 24 serves as a reference. In FIG. 3, that side, to which the spacer 25 is attached, is "the lower side". Therefore, that side opposite to the lower wall 26 (see FIG. 1) is "the upper side". When the connector of FIG. 2 is normally seen, the left side is "the left side" while the right side is "the right side". In FIG. 1, that side of the connector to be opposed to the mating connector 22 is "the front side", and that side of the connector, in which the connection terminals 23 are inserted, is "the rear side".

The above constituent members will be described below in detail. The connection terminals 23, the housing body 24 and the spacer 25 will be described in this order.

The connection terminal 23 is formed by pressing an electrically-conductive metal sheet into a predetermined shape, and the terminal 23 includes an electrical contact portion 45 and a wire connection portion 46, as shown in FIGS. 1 and 3.

The electrical contact portion 45 is formed into a rectangular box-like shape, and has a resilient contact piece portion (not shown) provided therein. A rectangular hole 48 is formed in a lower wall 47 of this electrical contact portion 45, and a lance 93 (see FIG. 9), which will be described later, can be engaged in the rectangular hole 48.

Although not shown in the drawings, an opening, through which the connection terminal 31 in the mating connector 22, can be inserted, is formed in a distal end of the electrical contact portion 45. When the connection terminal 31 in the mating connector 22 is inserted into the electrical contact portion 45 through the distal end thereof, the connection terminal 31 is brought into contact with the resilient contact piece portion (not shown).

The wire connection portion 46 is formed in continuous relation to the electrical contact portion 45, and a shoulder portion 49 for retaining engagement with the spacer 25 is formed at an interconnecting portion interconnecting the electrical contact portion 45 and the wire connection portion 46. That portion of a wire 50, at which a conductor is exposed, is press-held by the wire connection portion 46.

Figure 6:
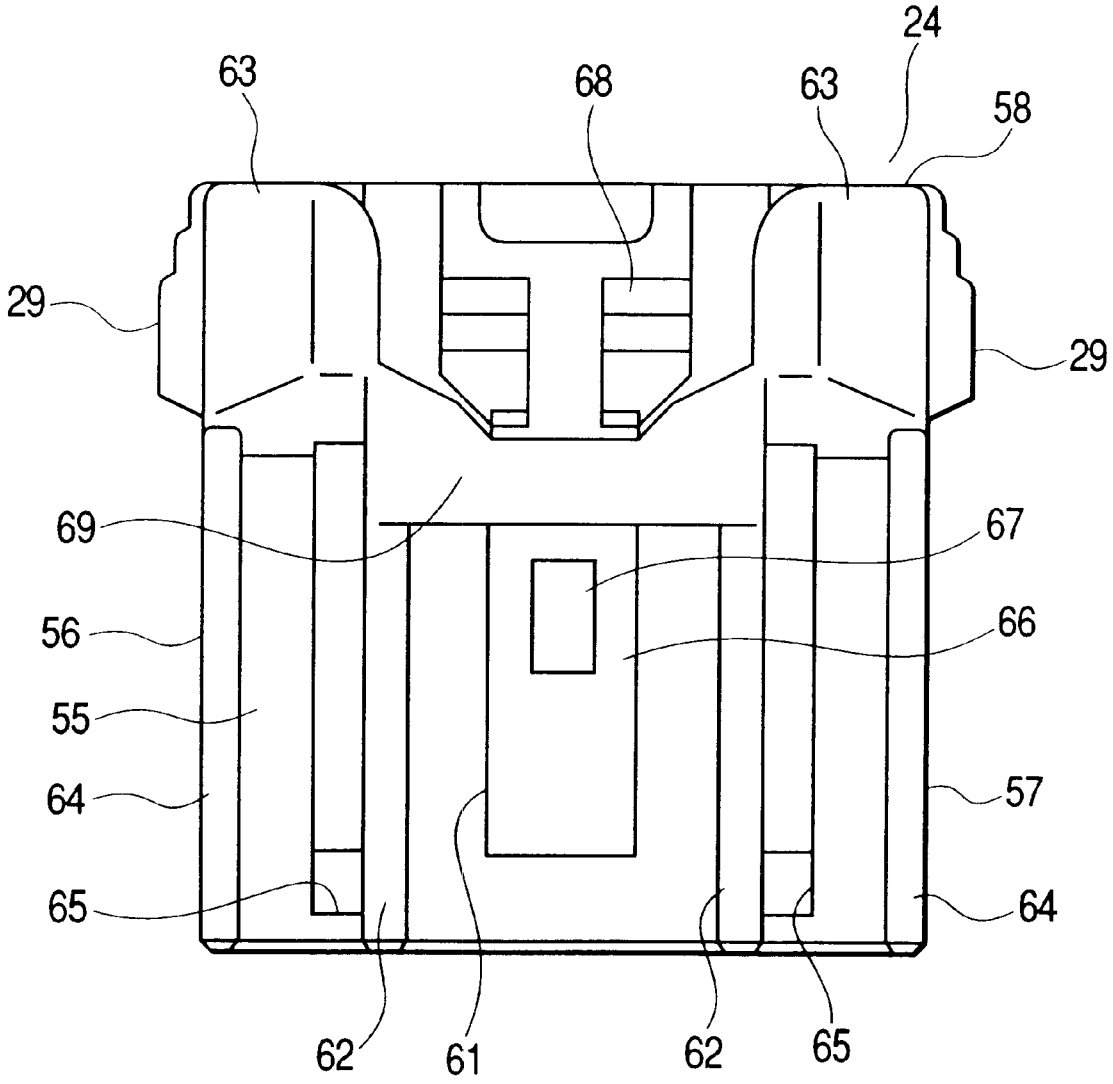
FIG. 6 is a plan view of a housing body.
Figure 7:
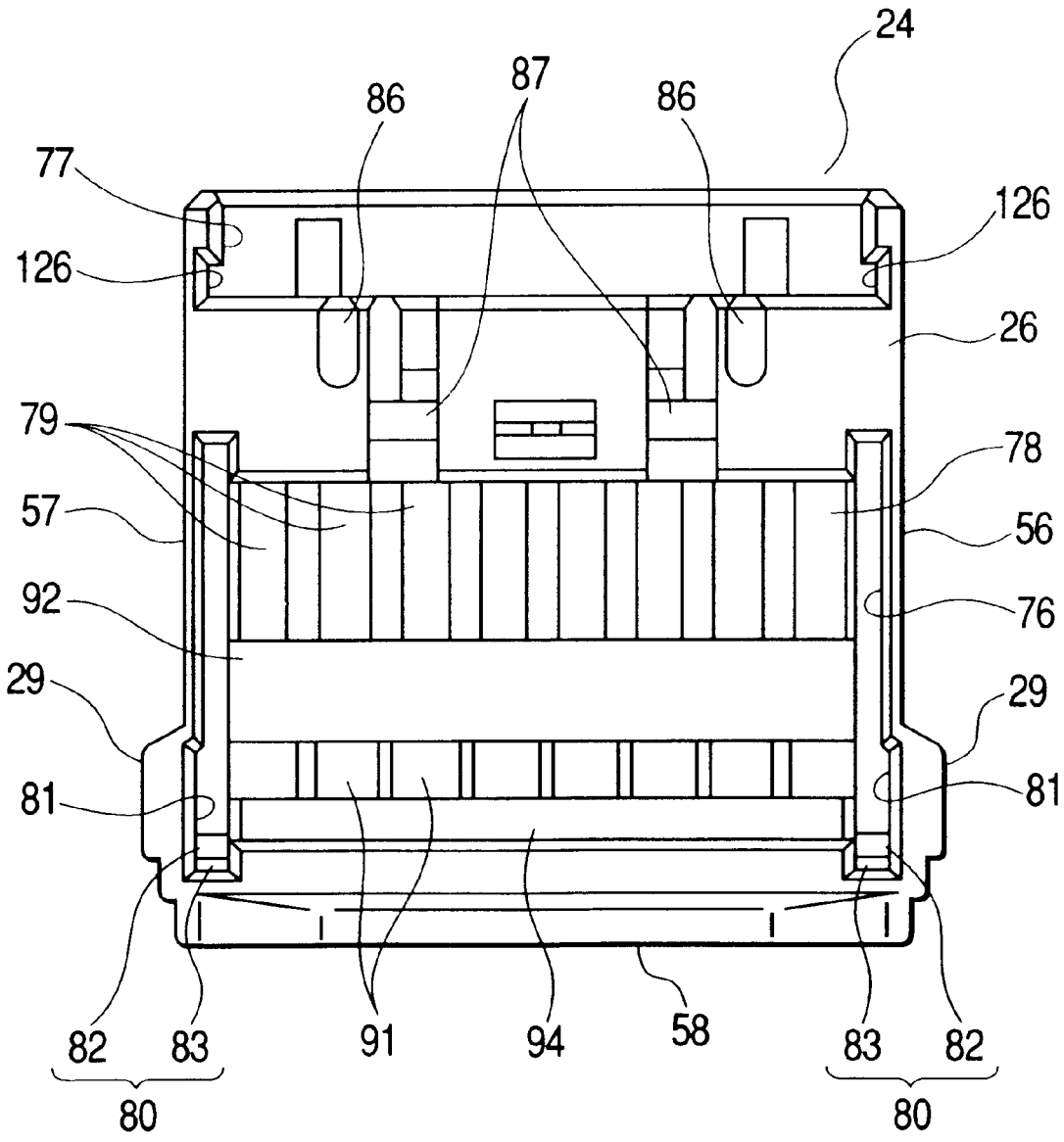
FIG. 7 is a bottom view of the housing body.
Figure 8:
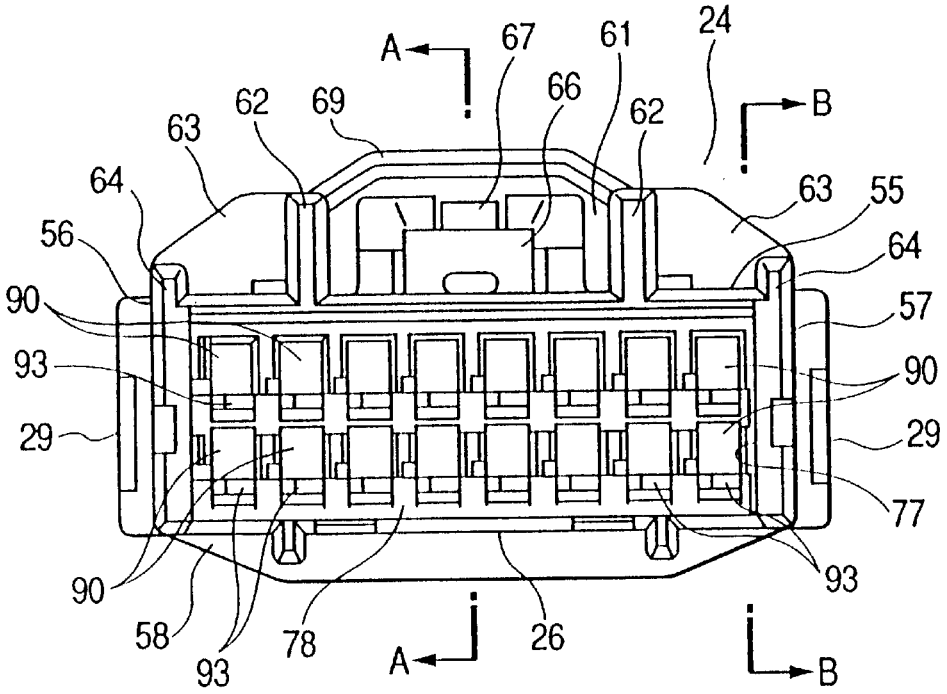
FIG. 8 is a front view of the housing body.
Figure 9:
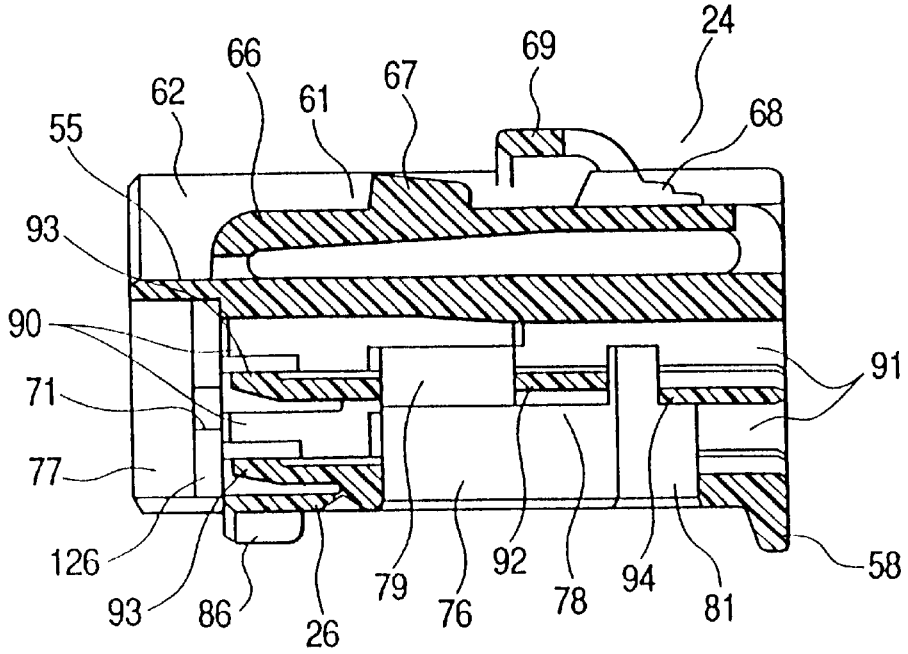
FIG. 9 is a cross-sectional view taken along the line A—A of FIG. 8.
Figure 10:
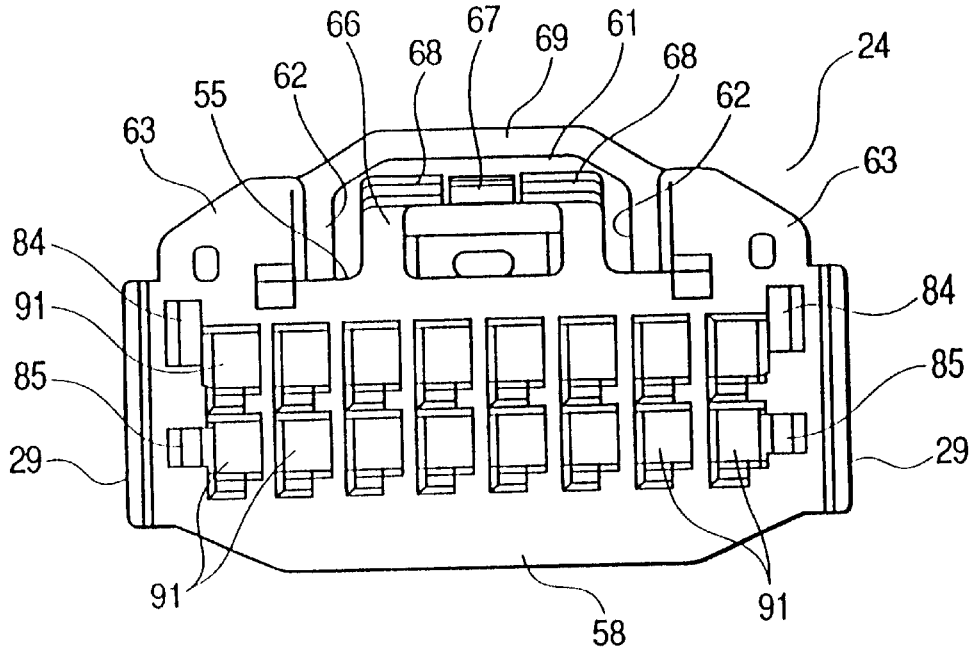
FIG. 10 is a rear view of the housing body.
Figure 11:
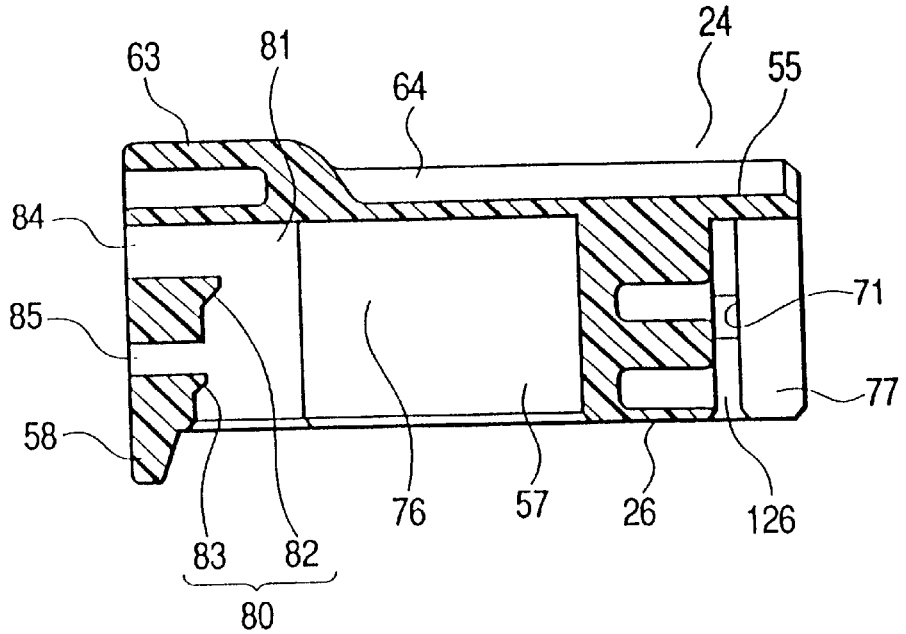
FIG. 11 is a cross-sectional view taken along the line B—B of FIG. 8.

Next, the housing body 24 will be described with reference to FIGS. 6 to 11. FIG. 6 is a plan view of the housing body, FIG. 7 is a bottom view of the housing body, FIG. 8 is a front view of the housing body, FIG. 9 is a cross-sectional view taken along the line A—A of FIG. 8, FIG. 10 is a rear view of the housing body, and FIG. 11 is a cross-sectional view taken along the line B—B of FIG. 8.

Like the mating connector housing 32 (see FIGS. 4 or 5), the housing body 24 is made of a synthetic resin, and has a generally rectangular box-like shape defined by the lower wall 26, an upper wall 55, disposed opposite to this lower wall 26, a left wall 56, a right wall 57 and a rear wall 58.

A lock member 61, a pair of guide rails 62 with a larger height, a pair of bulge portions 63 and a pair of guide rails 64 with a smaller height are formed on the upper wall 55, and also a pair of holes 65 for the front holder 28 (see FIG. 2) are formed in the upper wall 55.

The lock member 61, the pair of guide rails 62 and the pair of guide rails 64, formed on the upper wall 55, extend in a forward-rearward direction in parallel relation to one another. The bulge portions 63 are formed on a rear portion of the upper wall 55 disposed adjacent to the rear wall 58.

The lock member 61 includes a strip-like elastic piece 66 which is integrally connected at one end thereof to a front portion of the upper wall 55, and also is integrally connected at the other end thereof to the rear portion of the upper wall 55. A projection 67 for engagement in the lock portion 35 (see FIG. 4) of the connector housing 32 (see FIG. 4) is formed on the elastic piece 66 intermediate opposite ends thereof. A pressing portion 68 is formed on the other end portion of the elastic piece 66.

The lock member 61 is of such a construction that the elastic piece 66 can be elastically deformed by pressing the pressing portion 68.

The pair of guide rails 62, each having a piece-like configuration, are guided respectively by the guides 36 of the connector housing 32 (see FIG. 5), and a protector 69 for the lock member 61 is formed integrally with the rear ends of these guide rails. The protector 69 extends in the right-left direction of the upper wall 55. This protector is formed into an arch-shape with respect to the guide rails 62.

The pair of bulge portions 63, together with the guide rails 62, protect the lock member 61. The bulge portions 63 are integrally connected respectively to the rear ends of the guide rails 62, and also to the rear ends of the guide rails 64, respectively.

The pair of guide rails 64, each having a piece-like configuration, are guided respectively by the guides 37 of the connector housing 32 (see FIG. 5), and are formed integrally with the left wall 56 and the right wall 57, respectively.

The pair of holes 65 of a rectangular shape are provided respectively at the outer sides of the guide rails 62 (that is, adjacent respectively to the left wall 56 and the right wall 57), and are formed through the front portion of the upper wall 55.

A hole 71 for the finger pad 29 and the front holder 28 (see FIG. 2) is formed in the left wall 56. The hole 71 is formed through a front portion of the left wall 56.

The finger pad 29 is formed on the outer face of the left wall 56 at the rear portion thereof, and projects outwardly (in the left direction) from this outer face. The distal end (outer face) of the finger pad 29 in its projecting direction is disposed inwardly of an outer face of a left wall 72 of the connector housing 32 (see FIGS. 4 or 5). When fitting the connector into the mating connector 22 (see FIG. 1), the finger is held on the finger pad 29, and therefore the finger pad 29 will not engage the fitting portion 42 of the mating connector 22 (see FIG. 1).

As described above for the left wall 56, a hole 71 for the finger pad 29 and the front holder 28 (see FIG. 2) is formed in the right wall 57. This hole 71 is formed through a front portion of the right wall 57 as described above for the left wall 56.

The finger pad 29 on the right wall 57 is formed on the outer face of this right wall 57 at the rear portion thereof, and projects outwardly (in the right direction) from this outer face. The distal end (outer face) of the finger pad 29 in its projecting direction is disposed inwardly of an outer face of a right wall 73 of the connector housing 32 (see FIG. 4 or FIG. 5).

A spacer mounting hole 76 and a front holder mounting hole 77 are formed in the lower wall 26. A terminal receiving portion 78 is formed within the housing body 24, and extends from the rear wall 58 to the front holder mounting hole 77. The terminal receiving portion 78 has a plurality of terminal receiving chambers 79.

The spacer mounting hole 76 extends from an intermediate portion of the lower wall 26 to the rear portion thereof, and also extends from the lower wall 26 toward the upper wall 55. The spacer mounting hole 76 communicates with the plurality of terminal receiving chambers 79, and extends into the inner faces of the left and right walls 56 and 57.

Body-side retaining portions 80 for the spacer 25 (see FIG. 1) are formed in inner faces of the spacer mounting hole 76. The body-side retaining portions 80 include recesses 81, respectively, which communicate with the spacer mounting hole 76.

One body-side retaining portion 80 is formed at a region including a rear portion of a left edge of the spacer mounting hole 76 and a rear edge of this hole 76, whereas the other body-side retaining portion 80 is formed at a region including a rear portion of a right edge of the spacer mounting hole 76 and the rear edge of this hole 76. Each of the body-side retaining portions 80 includes a first retaining portion 82 (see FIG. 11 in which only one of them is shown), and a second retaining portion 83 (see FIG. 11 in which only one of them is shown). Reference numerals 84 and 85 denote mold removal holes used for forming the first and second retaining portions 82 and 83.

The recesses 81 are formed in the inner face of the right and left walls 56 and 57 so as to oppose to the finger pads 29, respectively. The recesses 81 are provided as widened groove portions extend from the opening edge (that is, respectively from the left and right edges) of the spacer mounting hole 76 in the direction of mounting of the spacer 25 (that is, in the upward-downward direction).

Part of the body-side retaining portions 80 are provided at the recess portions 81, and therefore even when the connector is formed into a compact design, a sufficient retaining force for retaining the spacer 25 can be secured. The body-side retaining portions 80 may be formed entirely by the recess portions 81.

Reference numerals 86 denote guide rails which are guided respectively by the guides 41 (see FIG. 5). Reference numerals 87 denote recessed portions for the hinges 27 (see FIG. 1).

The front holder mounting hole 77 is formed in the front portion of the lower wall 26, and extends therefrom toward the upper wall 55. The front holder mounting hole 77 communicates with the terminal receiving portion 78, and extends into the inner faces of the left and right walls 56 and 57.

The front holder mounting hole 77 is formed to provide the open front side of the housing body 24. The holes 65, formed in the upper wall 55, and the holes 71, formed respectively in the left and right walls 56 and 57, communicate with the front holder mounting hole 77.

The terminal receiving portion 78 includes the plurality of terminal receiving chambers 79, a plurality of terminal inserting portions 90, formed in that portion of the lower wall 26 lying between the spacer mounting hole 76 and the front holder mounting hole 77, a plurality of terminal inserting portions 91, formed in the rear wall 58, and a partition wall 92 exposed to the spacer mounting hole 76.

The terminal receiving chambers 79 of a generally groove-shape extend in the forward-rearward direction, and are arranged in only one row in the right-left direction. The partition wall 92 is formed integrally with the terminal receiving chambers 79. The partition wall 92 extends in the right-left direction so as to divide part of terminal receiving chambers 105 (see FIGS. 13 and 14) in the spacer 25 (see FIG. 1).

The plurality of terminal inserting portions 90 are arranged in two (upper and lower) rows, each row of terminal inserting portions 90 being arranged in the right-left direction. A lance 93 for engagement in the hole 48 (see FIG. 1) in the connection terminal 23 (see FIG. 1) is formed in a projected manner within each of the terminal inserting portions 90. The lance 93 has elasticity, and serves to prevent the withdrawal of the connection terminal 23 (see FIG. 1).

The plurality of terminal inserting portions 91 are arranged in two (upper and lower) rows, each row of terminal inserting portions 91 being arranged in the right-left direction. A partition wall 94, separating the two rows from each other, is formed, and part of this partition wall 94 projects into the spacer mounting hole 76.

The partition wall 94 is spaced from the partition wall 92, and when the spacer 25 (see FIG. 1) is attached to the connector, a partition wall 107 (described later) on the spacer 25 (see FIG. 1) is inserted into a space between the two partition walls 92 and 94.

Figure 12:
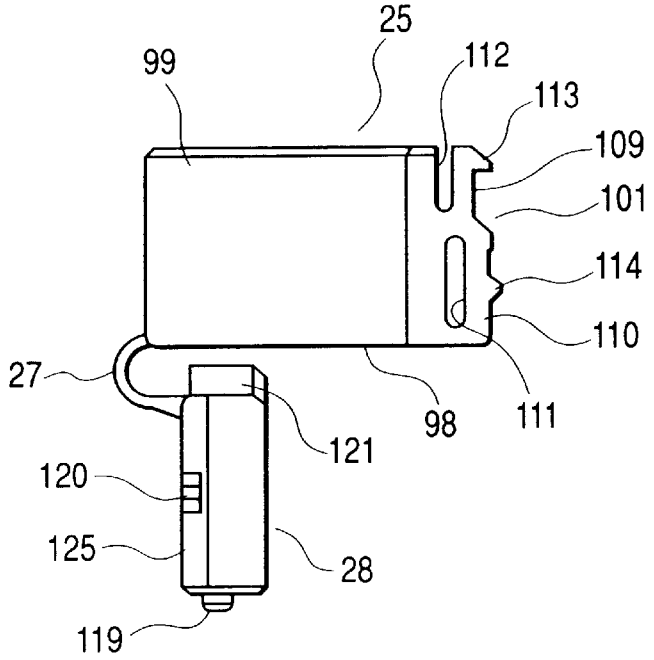
FIG. 12 is a side view of a spacer.
Figure 13:
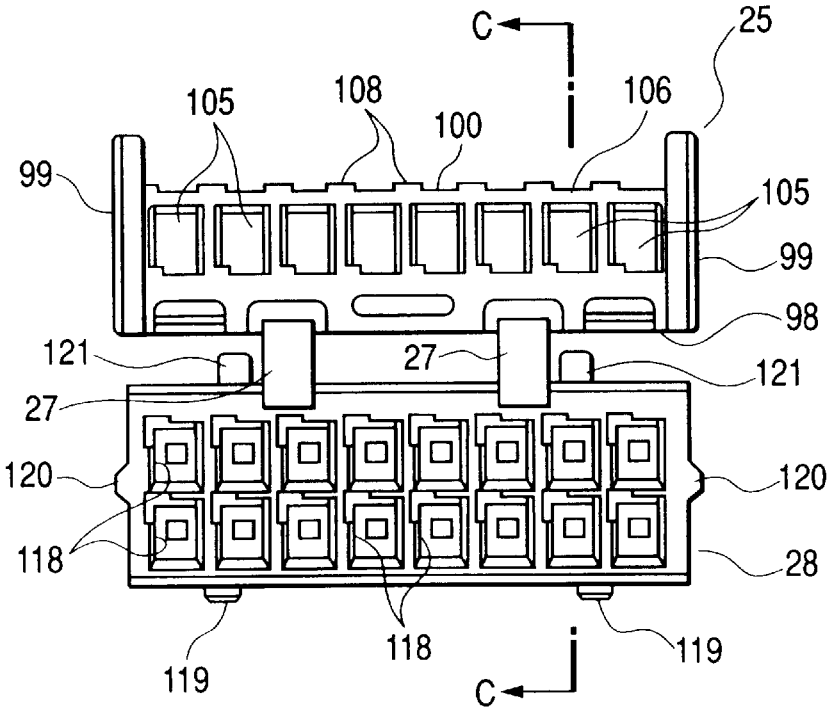
FIG. 13 is a front view of the spacer.
Figure 14:
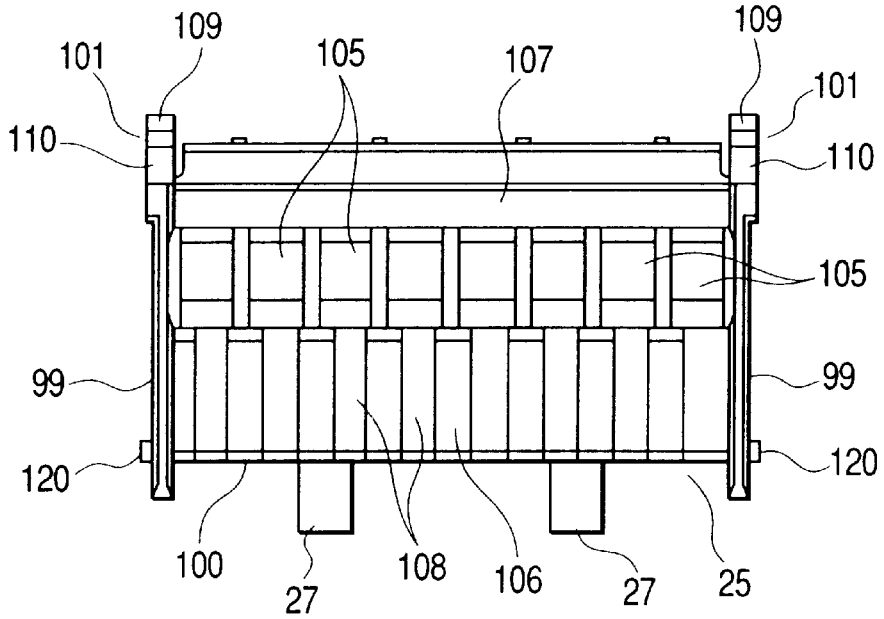
FIG. 14 is a plan view of the spacer.
Figure 15:
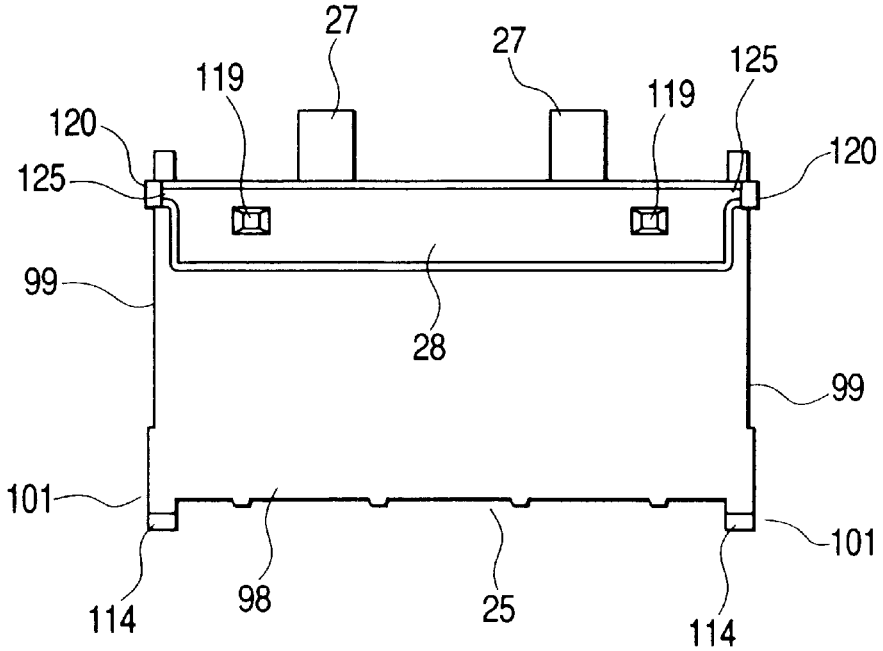
FIG. 15 is a bottom view of the spacer.
Figure 16:
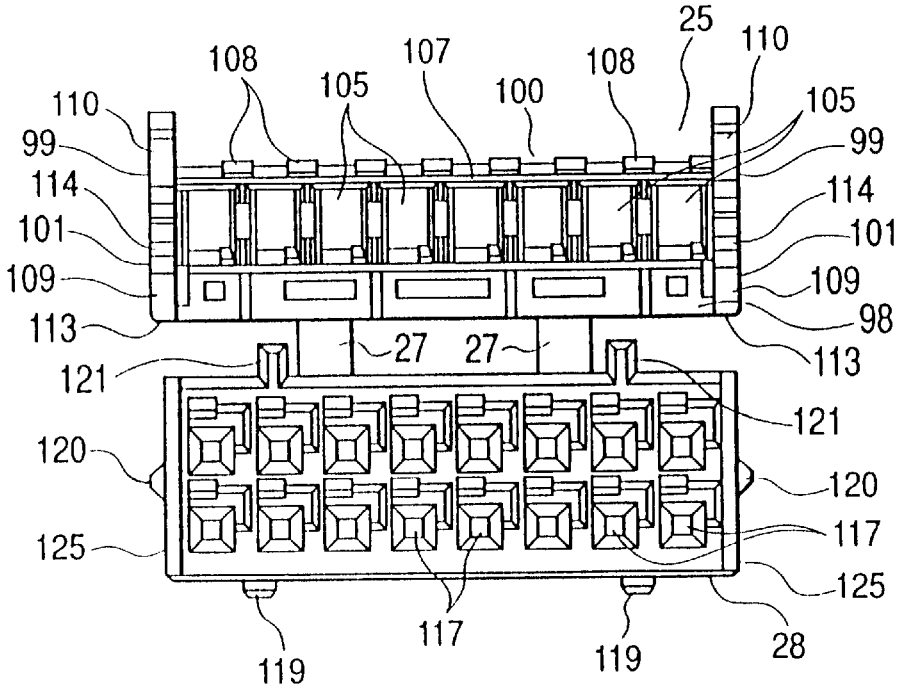
FIG. 16 is a rear view of the spacer.
Figure 17:
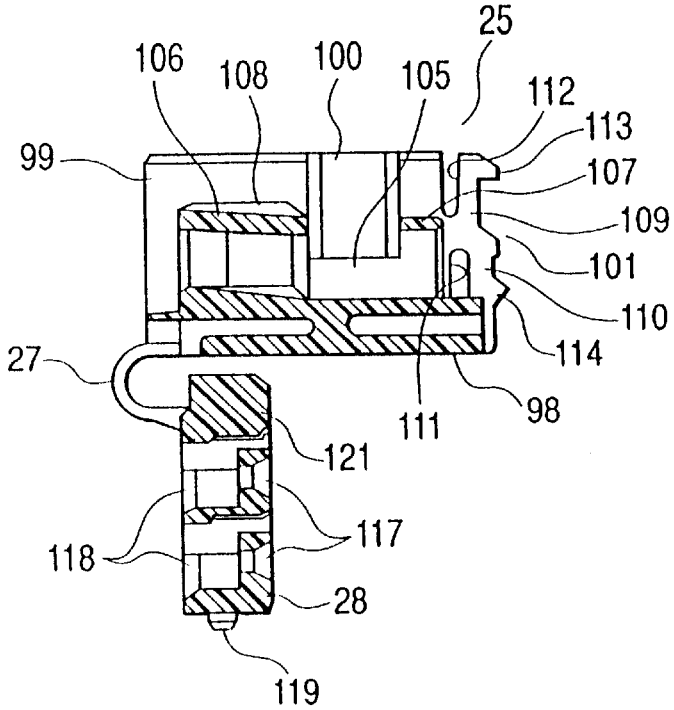
FIG. 17 is a cross-sectional view taken along the line C—C of FIG. 13.

Next, the spacer 25 will be described with reference to FIGS. 12 to 17. FIG. 12 is a side view of the spacer, FIG. 13 is a front view of the spacer, FIG. 14 is a plan view of the spacer, FIG. 15 is a bottom view of the spacer, FIG. 16 is a rear view of the spacer, and FIG. 17 is a cross-sectional view taken along the line C—C of FIG. 13.

Like the housing body 24 (see FIGS. 6 to 11), the spacer 25 is made of a synthetic resin, and includes a lid portion 98, conforming in shape to the opening of the spacer mounting hole 76 (see FIG. 7), side walls 99, integrally formed respectively at opposite (right and left) ends of the lid portion 98, a terminal receiving portion 100, formed by inner faces of the lid portion 98 and the side walls 99, and spacer-side retaining portions 101 formed respectively at rear portions of the side walls 99.

The front holder 28 is integrally connected to the band-like hinges 27 extending from a front portion of the lid portion 98, and this front holder 28 is disposed perpendicularly to the lid portion 98 immediately after the spacer is molded (The hinges 27 are bent when attaching the spacer to the connector). Of course, the front holder 28 is also made of the synthetic resin.

In this embodiment, the front holder 28 is provided as an added function of the spacer 25. Of course, there can be provided the type of connector without the front holder (as described above for the related example).

The side walls 99 have a length corresponding to the depth of the spacer mounting hole 76 (see FIG. 7), and these side walls 99 are so arranged as to be opposed respectively to the inner faces of the spacer mounting hole 76 (see FIG. 7).

The terminal receiving portion 100 includes the plurality of terminal receiving chambers 105, and partition walls 106 and 107. The plurality of terminal receiving chambers 105 extend in the forward-rearward direction, and are arranged between the side walls 99. These terminal receiving chambers 105 are arranged in one row.

The partition walls 106 and 107 are spaced from each other by a distance corresponding to the dimension of the partition wall 92 (see FIG. 7) in the forward-rearward direction. These partition walls extend in the right-left direction.

Retaining portions 108 each for engagement with the shoulder portion 49 of the associated connection terminal 23 (see FIG. 3) are formed at the terminal receiving chambers 105 and the partition wall 106. The retaining portion 108 and the lance 93 (see FIG. 9) serve to prevent the withdrawal of the connection terminal 23 (see FIG. 3). Thus, the connection terminal 23 (see FIG. 3) is doubly retained by the retaining portion 108 and the lance 93 (see FIG. 9).

The spacer-side retaining portions 101 can be engaged respectively with the body-side retaining portions 80 (see FIG. 11) so as to hold the spacer 25 in a provisionally-retained condition and a completely-retained condition. Each of the spacer-side retaining portions 101 includes a provisional retainer 109, a complete retainer 110, a through hole 111, and a slit 112. Since the spaces of the body-side retaining portions 80 (see FIG. 11) are secured, the spacer-side retaining portions 101 can maintain the sufficient retaining force.

The provisional retainers 109, as well as the slits 112, are formed at distal end portions of the side walls 99, respectively. As a result of formation of the slit 112, the provisional retainer 109 has an arm-like configuration, and a retaining projection 113 is formed on and projects rearwardly from a distal end of each of the provisional retainers 109. The provisional retainers 109 have sufficient elasticity.

The complete retainers 110, as well as the through holes 111, are formed at proximal end portions of the side walls 99, respectively. Each of the complete retainers 110 has a retaining projection 114 which is formed on and projects rearwardly from an intermediate portion of the rear end of the side wall 99. Because of the provision of the through hole 111, each of the complete retainers 110 can be elastically deformed to be displaced.

In accordance with the arrangement of the recesses 81 (see FIG. 7), the outer faces of the spacer-side retaining portions 101 project outwardly from the outer faces of the side walls 99, respectively. In accordance with the configuration of the body-side retaining portions 80 (see FIG. 7), each of the spacer-side retaining portions 101 slightly projects rearwardly.

The front holder 28 is formed into a rectangular shape, and a plurality of terminal insertion ports 117 are formed in that side of this front holder which is to be opposed to the mating connector 22 (see FIG. 1), and are arranged in two (upper and lower) rows. Terminal stoppers 118 are formed on that side of the front holder which is to be opposed to the terminal inserting portions 90 (see FIG. 8), and correspond respectively to the plurality of terminal insertion ports 117. The terminal insertion ports 117 communicate with the terminal stoppers 118, respectively.

Projections 119, which can be engaged respectively in the holes 65 (see FIG. 6), projections 120, which can be engaged respectively in the holes 71 (see FIG. 11), and ribs 121, which can coincide respectively with the guide rails 86, are formed on the outer peripheral face of the front holder 28.

Next, an assembling operation for the connector 21, comprising the connection terminals 23, the housing body 24 and the spacer 25, will be described.

First, the front holder 28 is mounted in the front holder mounting hole 77. The projections 120 on the front holder 28 are engaged respectively in the holes 71, thereby preventing the withdrawal of the front holder. At this time, guide rails 125 (see FIG. 15), formed on the front holder 28, are guided into groove-like guides 126 (see FIG. 7) formed in the inner faces of the front holder mounting hole 77.

Figure 18:
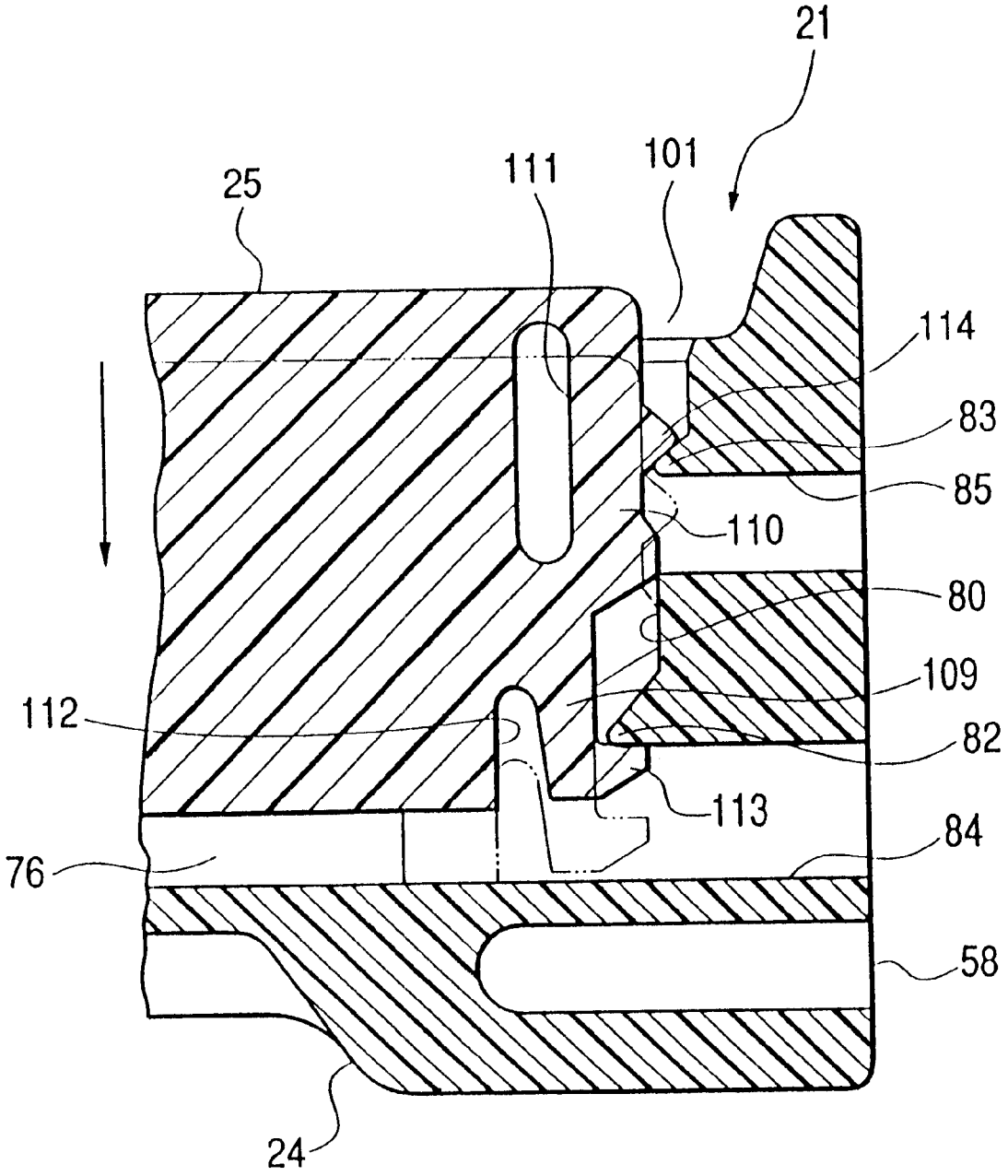
FIG. 18 is an enlarged, cross-sectional view explanatory of a provisionally-retained condition and a completely-retained condition of the spacer.
Figure 19:
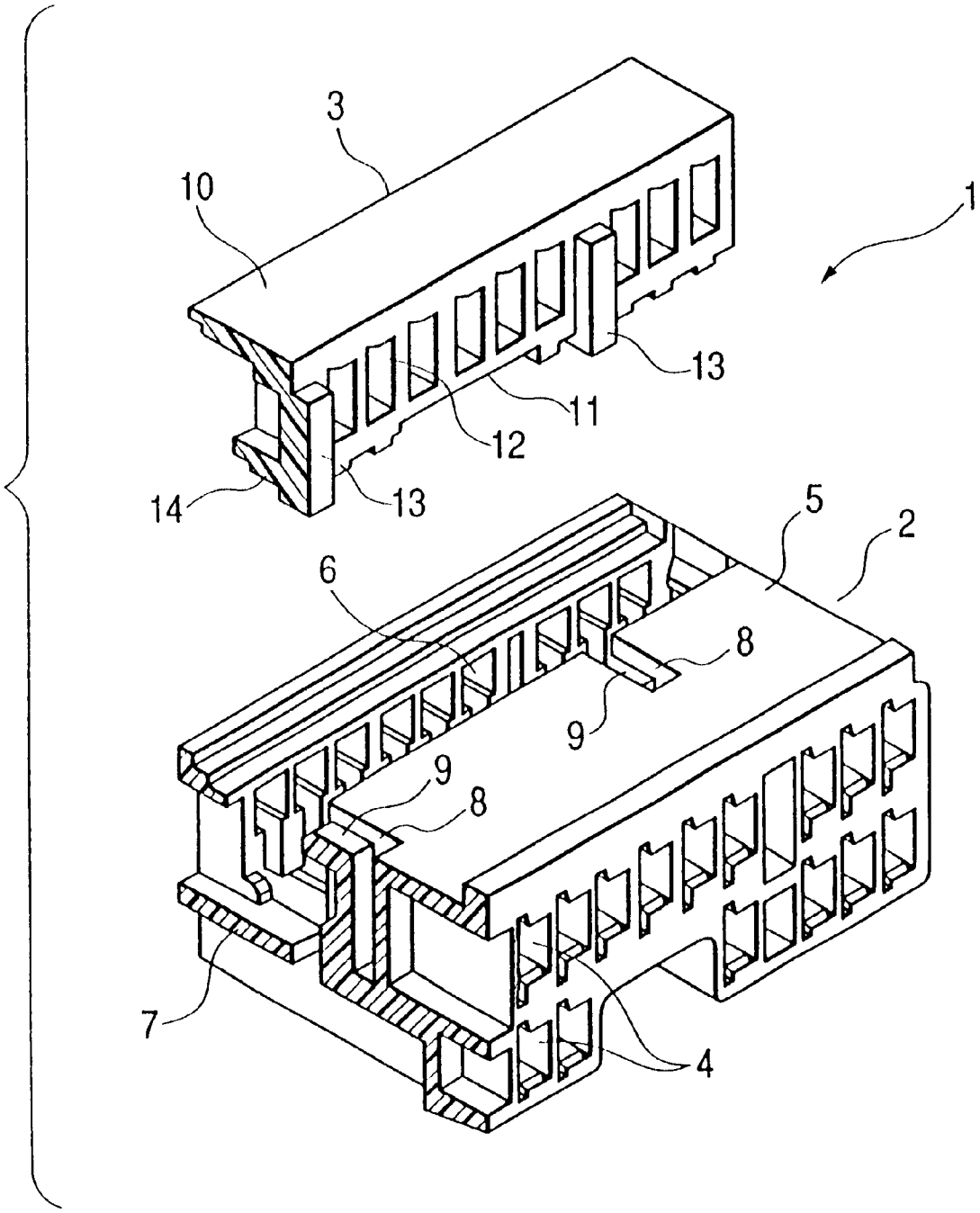
FIG. 19 PRIOR ART
FIG. 19 is a partly cross-sectional, exploded perspective view of a related connector.

Then, the spacer 25 is provisionally retained in the spacer mounting hole 76 (see FIG. 18). In this mounting operation, each of the provisional retainers 109 is elastically deformed. When the provisional retainer 109 slides past the first retaining portion 82, the provisional retainer 109 and the complete retainer 110 hold the first retaining portion 82 and the second retaining portion 83 therebetween. As a result, the spacer 25 is held in the provisionally-retained condition.

In this condition, the connection terminals 23 can be inserted through the rear wall 58. The connection terminals 23, when thus inserted, are mounted and received in the terminal receiving chambers 79, respectively. Each of the connection terminals 23 is retained by the associated lance 93, and therefore is prevented from being withdrawn from the rear wall 58. Also, the forward movement of the connection terminal 23 is prevented by the associated terminal stopper 118 on the front holder 28.

After all of the connection terminals 23 are mounted and received in the connector, the spacer 25 is completely retained. When each of the complete retainers 110 is elastically deformed, and slides past the second retaining portion 83, the spacer 25 is completely engaged in the spacer mounting hole 76 (see imaginary lines in FIG. 18). The complete retainers 110 and the second retaining portions 83 prevent the disengagement of the spacer 25.

When the spacer 25 is thus completely retained, the retaining portions 108 on the spacer 25 are engaged respectively with the shoulder portions 49 of the connection terminals 23, thereby doubly retaining these connection terminals 23. Therefore, the connection terminals 23 are positively prevented from being withdrawn from the rear wall 58.

Thus, the sequential steps of the process of assembling the connector 21 are completed.

As described above with reference to FIGS. 1 to 18, the distance between the left wall 56 and the right wall 57 of the housing body 24 is made smaller by an amount, corresponding to the dimensions of the recesses 81, as compared with the related construction. And besides, the spacer-side retaining portions 101 are formed respectively on those portions of the spacer 25 corresponding respectively to the recesses 81, and therefore the spacer 25, as well as the housing body 24, is formed into a compact design. Because of the provision of the recesses 81, the spacer-side retaining portions 101 do not have a reduced thickness, and their retaining force for the spacer 25 is maintained generally at the same level as that obtained with the related construction.

Various modifications can be made without departing from the scope of the invention.

For example, the connection terminals 23 can be replaced by male terminals. The invention can be applied to a housing body of the female type so that such male terminals can be received and retained in the housing body.

What is claimed is:

1. A connector comprising:

a housing body provided with a pair of first retainers and a plurality of terminal chambers for accommodating a plurality of connection terminals;

a spacer attached to the housing body for doubling retaining the connection terminals in the housing body, provided with a pair of second retainers which is to be engaged with the first retainers when the spacer is attached to the housing body; and a pair of finger pads respectively protruded from outer faces of both side walls of the housing body, on which an user's fingers are abutted to perform connection with respect to a mating connector, wherein the spacer is attached into a mounting hole formed in either a top face or a bottom face of the housing body so as to communicate with the respective terminal chambers and to include inner faces of the both side walls of the housing body; and wherein the mounting hole has widened portions at portions opposing to the respective finger pads while including at least a part of the first retainers to maintain retaining forces thereof, and has narrowed portions at portions not opposing to the respective finger pads to downsize the spacer.

2. The connector as set forth in claim 1, wherein each of the second retainers includes a provisional retainer for provisionally engaging the spacer with the housing body, and a complete retainer for completely engaging the spacer with the housing body.

3. The connector as set forth in claim 2, wherein the provisional retainers and the complete retainers are provided as projections; and wherein either a slit or a through hole is formed in the vicinity of the respective provisional retainers and the complete retainers.

4. The connector as set forth in claim 1, wherein the spacer includes a front holder connected via a hinge, and the front holder is engaged with a front portion of the housing body to regulate positions of the connection terminals accommodated in the housing body.

5. The connector as set forth in claim 1, wherein a widthwise dimension of the connector including the finger pads is so determined as to be smaller than a widthwise dimension of the mating connector.

* * * * *